US007401908B2

(12) United States Patent
Graveson et al.

(10) Patent No.: US 7,401,908 B2
(45) Date of Patent: Jul. 22, 2008

(54) INK JET DEVICE WITH INK DEAERATOR

(75) Inventors: Sandra J. Graveson, Enfield, NH (US); Alan Menard, Ashford, CT (US)

(73) Assignees: Heidelberger Druckmaschinen AG, Heidelberg (DE); Dimatix, Inc., Lebanon, NH (US)

( * ) Notice: Subject to any disclaimer, the term of this patent is extended or adjusted under 35 U.S.C. 154(b) by 297 days.

(21) Appl. No.: 11/095,239

(22) Filed: Mar. 31, 2005

(65) Prior Publication Data

US 2006/0221145 A1 Oct. 5, 2006

(51) Int. Cl.
*B41J 2/175* (2006.01)

(52) U.S. Cl. ..... 347/85

(58) Field of Classification Search ..... 347/65, 347/66, 85, 87, 92
See application file for complete search history.

(56) References Cited

U.S. PATENT DOCUMENTS 4,814,786 A * 3/1989 Hoisington et al. ..... 347/88
4,961,082 A 10/1990 Hoisington et al. ..... 346/140
5,189,438 A 2/1993 Hine et al.
5,489,925 A * 2/1996 Brooks et al. ..... 347/6
5,646,666 A * 7/1997 Cowger et al. ..... 347/87
5,831,653 A 11/1998 Brandon et al.
5,910,810 A 6/1999 Brooks et al.
6,447,093 B1 * 9/2002 Asakawa et al. ..... 347/21

FOREIGN PATENT DOCUMENTS

EP 0 709 212 5/1996

* cited by examiner

*Primary Examiner*—Anh. T. N. Vo
(74) *Attorney, Agent, or Firm*—Davidson, Davidson & Kappel, LLC

(57) ABSTRACT

An ink jet device includes an ink jet print head and a deaerator having an ink passage, a membrane and a vacuum chamber. The ink passage has an exit connected to the ink jet print head and an inlet, and the membrane has a first side and a second side. The first side contacts ink in the ink passage and the second side contacts the vacuum chamber. The inlet of the ink passage is located above the exit.

10 Claims, 1 Drawing Sheet

INK JET DEVICE WITH INK DEAERATOR

BACKGROUND OF THE INVENTION

The present invention relates generally to ink jet devices, and more particularly to ink jet devices with an ink deaeration function.

U.S. Pat. No. 4,961,082 describes the deaeration of ink in an ink jet system in which ink flows from a reservoir upwardly past membranes having a reduced pressure on a side opposite the ink. The reduced pressure deaerates the ink which then exits an orifice. U.S. Pat. No. 4,961,082 is hereby incorporated by reference herein.

European Patent Application No. 0 709 212 describes a pen-based degassing scheme for ink jet pens which has a heater element to remove gases in a standpipe region of an ink jet cartridge.

BRIEF SUMMARY OF THE INVENTION

An object of the present invention is to improve deaeration of ink in an ink jet print head. Another additional or alternative object of the present invention is to improve the printing quality of ink jet print heads.

The present invention provides an ink jet device comprising:

an ink jet print head; and a deaerator having an ink passage, a membrane and a vacuum chamber, the ink passage having an exit connected to the ink jet print head and an inlet, the membrane having a first side and a second side, the first side contacting ink in the ink passage and the second side contacting the vacuum chamber, the inlet of the ink passage being located above the exit.

By having the inlet of the ink passage located above the exit, air bubbles present in the ink passage may rise and leave the deaerator via the inlet.

Preferably, the ink passage becomes progressively lower over an entire extent between the inlet and the exit, so that air bubbles are not trapped between the inlet and the exit.

The ink passage thus may be planar, the ink passage having a constant angled slope downwardly between the inlet and the exit.

The downward angle preferably, but not necessarily, is less than 30 degrees and most preferably is between 5 and 15 degrees, for example 10 degrees. This can provide a smooth ink flow and limit the vertical space required by the ink jet device, which can be highly advantageous, for example when the ink jet device is retrofitted or used in an existing printing press design.

The ink jet print head preferably has nozzles facing downwardly. However, another orientation such as a sideways orientation is possible.

The ink jet device preferably includes an unpressurized ink supply connected to the inlet.

The ink supply preferably is an ink supply reservoir located above the inlet. The ink supply reservoir may be subjected to atmospheric pressure.

The present invention also provides a printing machine comprising:

a printing unit printing a substrate; and an ink jet printing device as described printing the substrate.

The present invention also provides a method for deaerating ink in an ink passage, the ink passage having an exit connected to an ink jet print head and an inlet, the method comprising adjusting a height of the inlet with respect to the exit so as to permit air bubbles in the ink passage to rise through the inlet.

BRIEF DESCRIPTION OF THE DRAWINGS

A preferred embodiment of the present invention is described below by reference to the following drawing, in which.

DETAILED DESCRIPTION OF A PREFERRED EMBODIMENT

Figure 1:
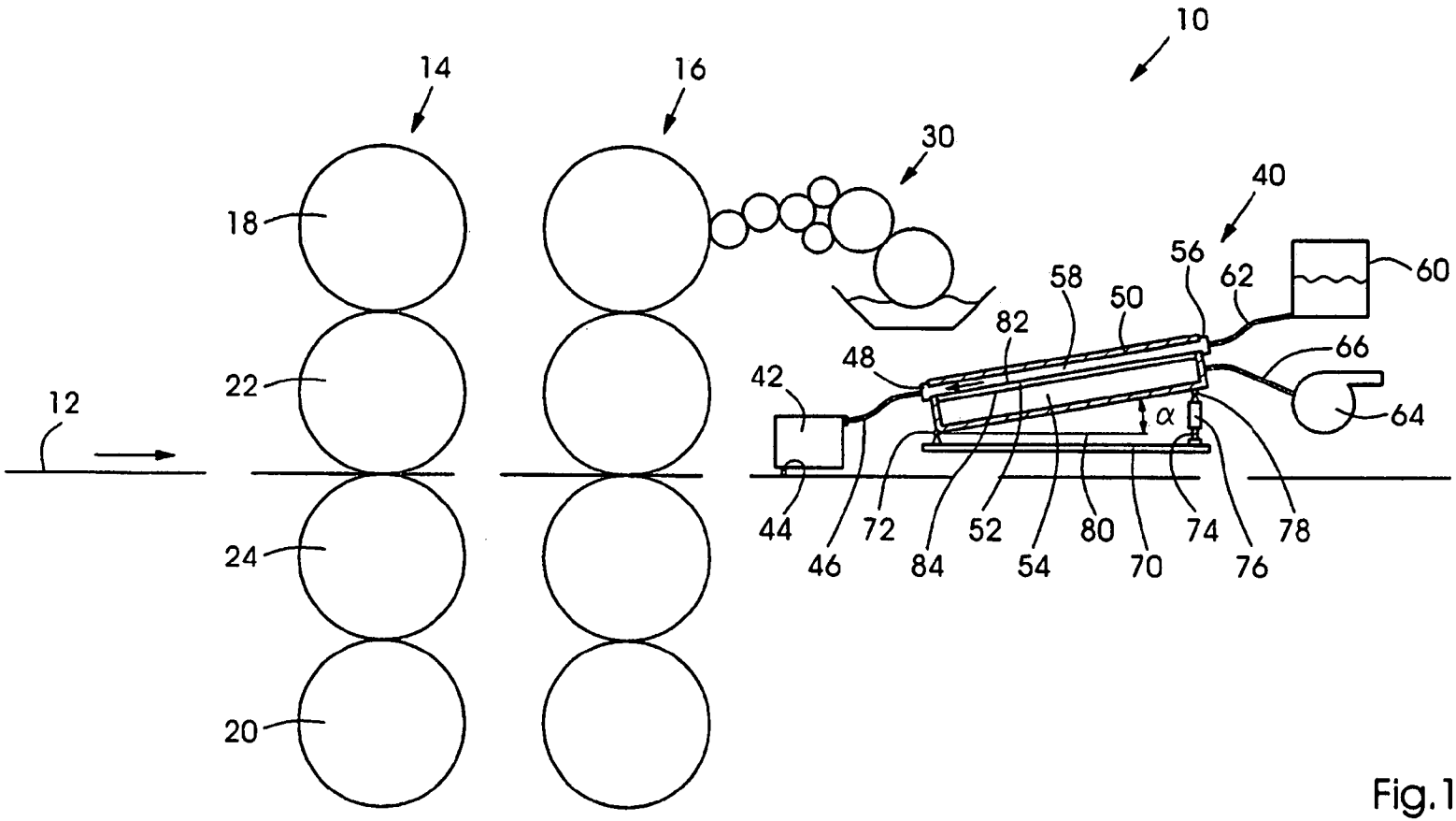
FIG. 1 shows a cross-section view of a sheet-fed offset lithographic printing machine having an ink jet printing device according to the present invention.

FIG. 1 shows a side view of a sheet-fed printing machine 10 for printing sheets 12 and having a first offset printing unit 14 and a second offset printing unit 16, for example each printing unit 14, 16 printing one of a plurality of colors. Each printing unit may have plate cylinders 18, 20 and blanket cylinders 22, 24. Four offset printing units or more may be provided to print for example cyan, magenta, yellow and black.

An inking and/or damping unit 30 may provide ink or dampening solution to the offset printing unit 16.

An ink jet device 40 includes an ink jet print head 42 having an ink jet nozzle assembly having nozzles 44 oriented downwardly in this embodiment for delivering ink to the sheets 12.

Ink jet device 40 includes a deaerator 50 having an ink passage 58, a membrane 52 and a vacuum chamber 54. Ink passage 58 has an exit 48 connected to the jet print head 42 via a line 46 and an inlet 56 connected by a line 62 to an ink supply reservoir 60. Ink in ink supply reservoir 60 may be open to the atmosphere. Membrane 52 has a first side 82 contacting ink in the ink passage 58 and a second side 84 contacting the vacuum chamber 54, and may be similar for example to membranes disclosed in incorporated-by-reference U.S. Pat. No. 4,961,082.

Vacuum chamber 54 or an addition vacuum chamber may be located above ink passage 58 so that air bubbles would rise toward the membrane 52 or an additional membrane for the additional vacuum chamber.

Vacuum chamber 54 may be connected by a line 66 to a vacuum source 64.

Deaerator 50 may be supported fixedly at an angle, for example by a frame. Alternately an adjustment device may be provided. For example deaerator 50 may be supported on a table 70, with for example four legs sitting on the table, the rear and front legs attached pivotally to the deaerator 50 via pivots 72 and 78, respectively. The front two legs for example may have an adjustment mechanism for adjusting an angle $\alpha$ of the deaerator 50 and thus the ink passage 58 with respect to a horizontal 80. For example, two of the legs may have an externally-threaded base portion 74 interacting with a hollow interiorly-threaded portion 76 connected to pivot 78. By screwing the base portion 74, for example by hand, with respect to the portion 76 the angle $\alpha$ can be adjusted. However, for adjusting the angle (if such adjustment is desired) any type of angle adjustment mechanism can be used, such as wedges or shims. An automatic adjustment mechanism for example could be provided by a hydraulic or pneumatic cylinder. In other embodiments, deaerator 50 also may rest or be supported horizontally, and the ink passage may be angled within the deaerator 50.

Ink passage 58 preferably is planar and has a constant angled slope downwardly between the inlet 56 and the exit 48.

The downward angle α preferably is less than 30 degrees and most preferably is between 5 and 15 degrees, for example 10 degrees.

Lines 46, 62 and 66 can for example be flexible to permit adjustment of the deaerator 50.

The low angle can for example be highly advantageous when adding or retrofitting the ink jet device 40 into an existing printing machine. For example, if the ink jet device 40 is added as a varnishing unit after printing unit 16, and the dampening or inking units provide little vertical space for the ink jet device between printing unit 16 and for example a downstream heat-setting unit such as a dryer, the shallow angle may be highly advantageous.

The present invention aids in preventing air bubbles from entering the ink jet print head, which is advantageous since an air bubble in a pumping chamber can stop an ink jet from jetting. With the lung at an angle, the air bubbles rise, moving away from the exit connected to the ink jet print head, and move toward the inlet.

"Ink" as defined herein may be any liquid applied to a sheet material and capable of being exited using ink jet technology, and may include for example both pigmented liquids and colorless liquids such as varnishes.

LIST OF REFERENCE NUMERALS

10 sheet-fed printing machine
12 sheets
14 first offset printing unit
16 second offset printing unit
18 plate cylinder
20 plate cylinder
22 blanket cylinder
24 blanket cylinder
30 inking and/or damping unit
40 ink jet device
42 ink jet print head
44 ink jet nozzles
46 line
48 exit
50 deaerator
52 membrane
54 vacuum chamber
56 inlet
58 ink passage
60 ink supply reservoir
62 line
64 vacuum source
66 line
70 table
72 pivot
74 externally-threaded base portion
76 internally-threaded portion
78 pivot
80 horizontal
82 first membrane side
84 second membrane side

What is claimed is:

1. An ink jet device comprising:

an ink jet print head; and a deaerator having an ink passage, a membrane and a vacuum chamber, the ink passage having an exit connected to the ink jet print head and an inlet, the membrane having a first side and a second side, the first side contacting ink in the ink passage and the second side contacting the vacuum chamber, the inlet of the ink passage being located above the exit, wherein the ink passage becomes progressively lower over an entire extent between the inlet and the exit, and the ink passage has a downwardly angled slope between the inlet and the exit.

2. The ink jet device as recited in claim 1 wherein the downwardly angled slope is a constant angled slope between the inlet and the exit.

3. The ink jet device as recited in claim 2 wherein the downward angle is less than 30 degrees.

4. The ink jet device as recited in claim 3 wherein the downward angle is between 5 and 15 degrees.

5. The ink jet device as recited in claim 1 wherein the ink jet print head has nozzles facing downwardly.

6. The ink jet device as recited in claim 1 further comprising an unpressurized ink supply connected to the inlet.

7. The ink jet device as recited in claim 1 further comprising an ink supply reservoir connected to the inlet and located above the inlet.

8. The ink jet device as recited in claim 7 wherein the ink supply reservoir is subjected to atmospheric pressure.

9. A printing machine comprising:

a printing unit printing a substrate; and an ink jet printing device as recited in claim 1 providing a liquid to the substrate.

10. A method for deaerating ink in an ink passage of an ink jet device as recited in claim 1, the ink passage having an exit connected to an ink jet print head and an inlet, the method comprising:

adjusting the height of the inlet with respect to the exit so as to permit air bubbles in the ink passage to rise through the inlet.

* * * * *